US005912205A

United States Patent [19]

Lakes et al.

[11] Patent Number: 5,912,205

[45] Date of Patent: Jun. 15, 1999

[54] HEAT RESISTANT SECURITY DOCUMENT

[75] Inventors: A. Dale Lakes; Mark Dotson; Rajendra Mehta, all of Dayton, Ohio

[73] Assignee: The Standard Register Company, Dayton, Ohio

[21] Appl. No.: 08/790,198

[22] Filed: Jan. 30, 1997

[51] Int. Cl.[6] ..... B41M 5/40

[52] U.S. Cl. ..... 503/207; 503/201; 503/204; 503/206

[58] Field of Search ..... 428/195, 323, 428/537.5, 913; 430/126; 283/67; 503/200, 206, 207, 226, 201, 204; 427/150–152

[56] References Cited

U.S. PATENT DOCUMENTS

| | | |
|---|---|---|
| 3,293,114 | 12/1966 | Kenaga . |
| 4,046,404 | 9/1977 | Treier . |
| 4,477,518 | 10/1984 | Cremona et al. . |
| 4,798,820 | 1/1989 | Yaguchi et al. . |
| 5,017,416 | 5/1991 | Imperial et al. . |
| 5,045,426 | 9/1991 | Maierson et al. . |
| 5,209,515 | 5/1993 | Dotson et al. . |
| 5,250,492 | 10/1993 | Dotson et al. . |
| 5,284,816 | 2/1994 | Stephenson . |
| 5,342,649 | 8/1994 | Sarokin . |
| 5,427,415 | 6/1995 | Chang . |
| 5,595,590 | 1/1997 | Belding et al. . |

*Primary Examiner*—Bruce H. Hess
*Attorney, Agent, or Firm*—Killworth, Gottman, Hagan & Schaeff, L.L.P.

[57] ABSTRACT

A security document is provided containing a color-forming composition having an insulating material therein which allows the document to be passed through heated printing devices such as laser printers without the problem of premature color development. The color-forming composition includes a mixture of a color former, a color developer, and an insulating material. In a preferred embodiment, a toner adhesion-enhancing composition containing an insulating material is applied over the color-forming composition. The security document may be used to provide an authentication feature and/or an indication of attempted alterations from the use of solvents, heat or abrasion.

24 Claims, 2 Drawing Sheets

HEAT RESISTANT SECURITY DOCUMENT

BACKGROUND OF THE INVENTION

The present invention relates to a heat resistant security document containing at least one composition which activates to produce a color upon the application of a solvent, heat or abrasion. More particularly, the invention relates to a security document having an insulating material blended with such an activatable composition which allows the document to be passed through heated printing devices such as laser printers without the problem of premature color development. The composition(s) may be used to provide authentication and/or security features on a document.

Security documents are printed on a wide variety of commercial printing devices. Traditional mechanical impact printers have been typically been used in the past for printing information on security documents such as checks. The inks used with most impact printers adhere well to a document due to the partial penetration of the ink into the surface of the document substrate. In addition, dyes or other coatings may be applied to the documents to aid in the prevention of fraudulent alteration of security documents. For example, a solvent sensitive coating comprising a mixture of a color former and a color developer may be used to produce covert (i.e., initially colorless) images on a security document. If attempted alteration of such a document is made by the application of solvents, the color former and/or color developer dissolve and react to form a visible image on the substrate, providing easy detection of the attempted alteration.

However, with the advance of microcomputer technology, a number of faster printing methods have been developed to take advantage of the high-speed printing output which is now possible. Laser printers are an example of nonimpact printers which are faster, quieter, and more reliable than impact printers. Such printers operate by fusing toner images onto a substrate by passing the substrate through a pair of rolls which apply both heat and pressure. However, such printers have significant limitations which have prevented their wide use in printing documents such as checks and other security documents. One limitation is the inability to achieve satisfactory toner bonding on a large variety of paper products used to make such documents. Because of the lack of strong adherence of toner to paper, documents printed using such printers may be subject to deliberate alteration by counterfeiters, forgers, and the like.

Toner adhesion-enhancing coatings have been developed which improve the adhesion of toner to the documents. For example, U.S. Pat. No. 5,045,426 to Maierson et al describes a polymeric toner adhesion-enhancing composition for use on documents printed with noncontact printing devices. However, documents containing such toner adhesion-enhancing coatings may still be subject to alteration by other methods as the solvent sensitive coatings used in the art as described above cannot withstand passage through a laser printer. This is due to the high temperature of the toner fuser rollers which will melt the dye and/or developer and cause premature color development on the documents.

Accordingly, there is still a need in the art for a security document which may be printed using a high-speed printing device such as a laser printer without the problem of premature coloration and which has security features which can provide authentication of the document and/or indicate attempted alterations of the document.

SUMMARY OF THE INVENTION

The present invention meets that need by providing an insulating material for use on security documents which, in combination with a color-forming composition and/or a toner adhesion-enhancing composition, provides heat resistance to prevent premature coloration when the documents are passed through a printing device such as a laser printer. The security document may be used to provide an authentication feature and/or an indication of attempted alterations from the use of solvents, heat, or abrasion.

According to one aspect of the present invention, a security document is provided which is resistant to premature coloration by heat. The document comprises a substrate having first and second major surfaces with at least one of the major surfaces having thereon a composition which activates to produce a color upon the application of a solvent, heat sufficient to cause the composition to melt, or abrasion. The color-forming composition also includes an insulating material to provide heat resistance when the document is passed through a noncontact printing device such as a laser printer.

By resistant to premature coloration by heat, it is meant that the composition on the document will not activate to form a color when exposed to temperatures of about 450 to 475° F. (232.22 to 246.11° C.) for a period of about 0.5 seconds or less, which typically occurs when a document is passed through a noncontact printing device such as a laser printer. Accordingly, while the document will not activate prematurely when exposed to such a source of heat, it may still be activated when exposed to heat for a time and temperature which is sufficient to cause the reactants in the color-forming composition to melt, i.e., at a temperature of about 400° F. (204.44° C.) for at least about 1 second.

The color-forming composition preferably comprises a mixture of initially colorless color formers and color developers, and in a preferred embodiment, includes a binder. Preferably, the color former comprises a leuco dye having a melting point of greater than about 150° C. The color developer preferably comprises a phenolic resin having a melting point of greater than about 150° C. The composition is preferably applied to the substrate to provide a dry coating weight of between about 0.4 and 0.5 lbs./1300 $ft^2$ (1.52 to 1.9 $g/m^2$) (17×22", 500 sheet ream). The composition may be printed on one or more areas of the substrate and on one or both sides of the substrate. The composition may be printed in the form of covert warning indicia such as the word "VOID" or any other symbol which would alert a user to an attempted alteration. Alternatively, or in addition, the composition may be printed on the substrate in the form of covert authentication indicia such as the words "VALID" or "AUTHENTIC" or any other symbol which would indicate to a user the genuineness of the document. In one embodiment, the warning indicia are printed on one surface of the substrate, while the authentication indicia are printed on the opposite surface. In another embodiment, the warning and authentication indicia are interspersed on the same surface of the document.

The insulating material included in the color-forming composition functions to prevent heat transfer from the fuser rolls of a laser printer to the composition, thus preventing melting of the color former or color developer which would cause premature coloration on the substrate. The insulating material may be inorganic or organic and may comprise hollow or solid polymeric particles. The particles may be in the form of hollow tubes or spheres. A preferred insulating material comprises hollow polymeric spheres of polystyrene. The insulating material preferably comprises from about 10 to 20% by weight of the color-forming composition.

In a preferred embodiment of the invention, the security document further includes a toner adhesion-enhancing composition which overlies the color-forming composition, where the toner adhesion enhancing composition comprises a polymeric toner adhesion-enhancing coating and an insulating material. The toner adhesion-enhancing coating provides improved adhesion of toner particles to the security document when printed with a laser or other noncontact printer, while the insulating material functions to prevent heat transfer to the color-forming composition underneath. Preferably, the polymeric toner adhesion-enhancing coating comprises a synthetic or natural latex, such as a carboxylated styrene-butadiene latex or styrene-butadiene latex.

The insulating material preferably comprises from about 20 to 40% by weight of the toner adhesion-enhancing composition, and preferably comprises hollow polymeric spheres comprised of polystyrene. The toner adhesion-enhancing composition is preferably applied to the substrate to provide a dry coating weight of 0.25 to 0.35 lbs./1300 ft.$^2$ (0.95 to 2.8 g/m$^2$).

When the security document of the present invention is passed through a laser printer or other heated printing device, the color-forming composition is not activated due to the presence of the insulating material in the composition. However, if the document is exposed to any number of common solvents, the solvent will penetrate the toner adhesion-enhancing layer on the substrate and the composition will activate such that the warning and/or authentication indicia will become visible on the substrate. The indicia will also become visible if the document is exposed to heat for a time which is sufficient to melt the color forming and color developing reactants in the composition, or if the document is subjected to abrasion.

Accordingly, it is a feature of the present invention to provide a security document printed with a color-forming composition containing an insulating material which allows security documents to be printed using heated printing devices such as laser printers without premature color development on the document. It is a further feature of the invention to provide a toner adhesion-enhancing composition including an insulating material therein which may be coated over the color-forming composition. These, and other features and advantages of the present invention will become apparent from the following detailed description, the accompanying drawings, and the appended claims.

DETAILED DESCRIPTION OF THE PREFERRED EMBODIMENTS

Figure 1:
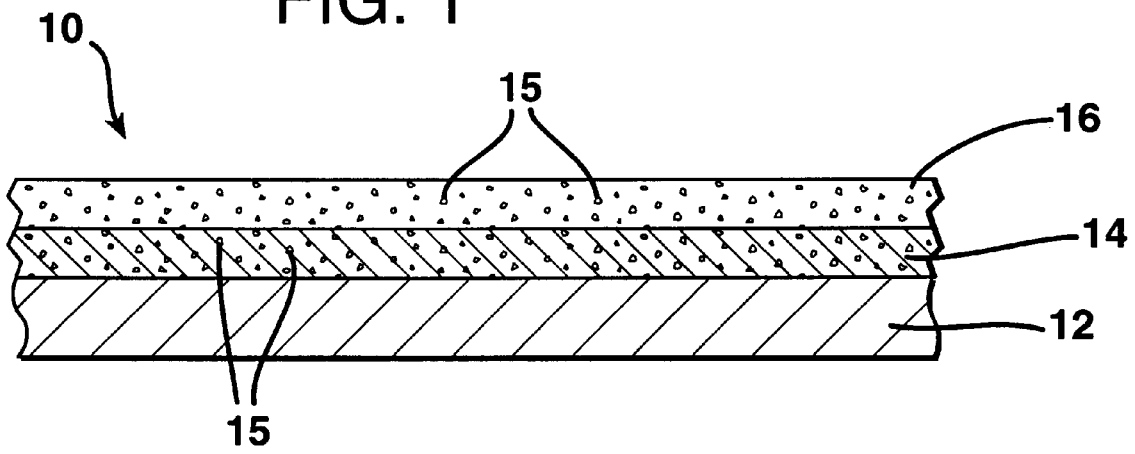
FIG. 1 is a fragmentary sectional view of a document substrate containing a color-forming composition and a toner adhesion enhancing composition which include an insulating material.

The use of an insulating material in combination with a color-forming composition and/or a toner adhesion-enhancing coating provides the capability to use high speed noncontact printing devices such as laser printers for printing a variety of security documents such as checks, negotiable certificates, transcripts, or other documents of value or documents which evidence value while still providing a means of detecting fraudulent alteration of such documents.

The insulating material used in the present invention is in particulate form and preferably comprises small diameter polymeric particles, and most preferably comprises hollow polymeric spheres of polystyrene. The particles may take the form of hollow tubes or spheres and may have a diameter of approximately 0.5 to 1 $\mu$m. A preferred insulating material is Rhopaque HP 1055, available from Rohm and Haas. Other suitable insulating materials include solid spheres of polystyrene available from Dow Chemical Company under the designation Dow 6622. Whether present in the color-forming composition, the toner-adhesion enhancing composition, or both, the insulating material functions to prevent, or at least retard, heat transfer to the color former and color developer in the color forming composition. Specifically, the insulating material prevents the leuco dye and color developer from reaching their melting points when exposed to the high temperatures generated from the heated fuser rollers of a laser printer, i.e., from about 450° to 475° F. (232.22° C. to 246.11° C.).

The insulating material may be combined with the other components in the color-forming composition and preferably comprises from about 10% to 20% by weight of the color-forming composition.

Suitable color forming dyes for use in the color-forming composition include any of the initially colorless dye precursors conventionally used in this art and include, but are not limited to, colorless leuco dye precursors such as crystal violet lactone, benzoyl leuco methylene blue, indolyl red, malachite green lactone, 8'-methoxybenzoindoline spiropyran, and rhodamine lactone.

Suitable color developers for use in the color-forming composition include, but are not limited to, phenolic resins such as acetylated phenolic resins, salicylic acid-modified phenolic resins, and novolac-type phenolic resins. A preferred phenolic resin is 4,4-sulfonyl diphenol. Both the color formers and color developers used should preferably have a melting point of greater than 150° C. to avoid premature coloration.

Preferably, the color-forming composition includes one or more binders which function to keep the composition in proper suspension for printing. Suitable binders include polyvinyl alcohol or a grafted starch solution. Preferred for use is a grafted starch solution as it enhances the quality and color development of the words, indicia, or patterns activated on the document substrate.

As can be seen in the drawing figures, the color-forming composition may be fully coated onto substantially the entire surface of the substrate, spot-coated onto only one or more predetermined areas of the substrate, or printed as words, symbols, or patterns. The color-forming composition may be printed as covert authentication indicia, warning indicia, or a combination of both.

For example, in embodiments where it is desirable to prevent fraudulent alteration of a document, covert indicia such as the words "VOID" or other images may be printed on the document. In embodiments where it is desirable to provide an authentication feature, words such as "VALID", "AUTHENTIC", or other words, symbols, patterns, images or designs, such as company logos or geometric shapes may be printed on the document.

It should be appreciated that many different combinations for placement of the color-forming composition on a security document are possible and are within the scope of this invention. For example, the composition may be printed as covert warning or authentication indicia on the entire document, or only in certain areas such as the area in which a signature or monetary value is present. It may desirable for some embodiments to include authentication indica on one portion of a document and covert warning indicia on another portion of a document. For example, on a security document such as a check, warning indicia may be printed in the areas containing monetary amounts while authentication indicia may be printed on other areas of the check which would not interfere with check processing. Alternatively, warning indicia could be printed on one side of a document and authentication indicia printed on the other side of the document.

In still other embodiments, it may be desirable to combine the authentication and warning indicia together as an interspersed pattern on a document such as VOID<>AUTHENTIC<>VOID<>AUTHENTIC etc. Whether the color-forming composition is printed as warning indicia, authentication indicia, or a combination thereof, the words or images should be printed so that they can easily be detected upon activation of the composition. Preferably, the color-forming composition is printed onto a security document by flexographic printing. The composition is preferably applied to provide a dry coating weight of between about 0.4 and 0.5 lbs/1300 $ft^2$ (1.52 to 1.9 $g/m^2$).

The resulting security document will provide authentication or show attempted alteration by the use of most oxygenated solvents including alcohols, ketones, esters and ethers. To increase the range of sensitivity of the color-forming composition, a hypochlorite sensitive compound such as amino benzyl thiozol (available from Bayer as Chlorostain OR) may also be included. This compound provides protection against the use of hypochlorite agents which could damage the color formers and/or color developers and leave the document susceptible to alteration by solvents.

In embodiments where both warning indicia and authentication indicia are present on a document, the color forming composition used to print the warning indicia may comprise a different composition than the color forming composition used to print the authentication indicia. For example, it may be desirable to have different compositions for the warning indicia and authentication indicia so that they may be activated by different solvents, i.e., the warning indicia could be printed with a color-forming composition which is activatable by a wide variety of solvents while the authentication indicia could be printed with a color-forming composition which is activatable by only one type of solvent.

The security document of the present invention will also provide authentication or show attempted alteration by the application of direct heat from a suitable heat source which causes the color forming and color developing reactants in the color-forming composition to melt and activate. The color-forming composition will also activate by abrasion such as vigorous rubbing. While not wishing to be bound by any particular theory, it is believed that the insulating material migrates to the surface of the printed indicia, and that vigorous rubbing removes the insulating surface layer on the document, allowing the color-forming reactants to come into intimate contact and/or become heated by friction such that they react.

In embodiments where a toner adhesion-enhancing composition is applied over the color-forming composition, the toner adhesion-enhancing composition is preferably applied to provide a dry coating weight of between about 0.25 and 0.35 lbs./1300 $ft.^2$ (0.95 and 1.33 $g/m^2$) (17×22", 500 sheet ream). Suitable toner adhesion-enhancing compositions are taught in U.S. Pat. No. 5,045,426 to Maierson et al, and U.S. Pat. No. 5,017,416 to Imperial et al, published PCT appln. No. U.S. No. 90/02071, the disclosures of which are hereby incorporated by reference. A preferred toner adhesion-enhancing composition comprises a natural or synthetic latex such as carboxylated styrene-butadiene latexes or styrene-butadiene latexes. Carboxylated styrene-butadiene latexes suitable for use in the present invention are available from the Dow Chemical Company under the designations 615NA, 620NA, and 722NA.

The toner adhesion-enhancing composition preferably further includes from about 20% to 40% by weight of the insulating material, which provides further insulation to the color-forming composition underneath. The toner adhesion-enhancing coating is preferably applied to the substrate as an aqueous dispersion, and is preferably applied over substantially the entire surface of the substrate to yield a dry coat weight of 0.3 to 0.4 lb/1300 $ft.^2$ (1.14 to 1.52 $g/m^2$).

With reference to the drawings, it must be appreciated that Patent Office requirements for solid black line drawings on a white surface make illustration of some of the subtleties of our invention relating to different colors difficult by the required Patent Office drawings alone. Reference to the following detailed description of the illustration will make full appreciation of the drawings and our invention possible.

Referring now to FIG. 1, a security document 10 is illustrated comprising a substrate 12 which has been coated with a color-forming composition 14 including an insulating material 15 and then coated with a toner-adhesion enhancing coating 16, which also preferably includes the insulating material 15.

Figure 2:
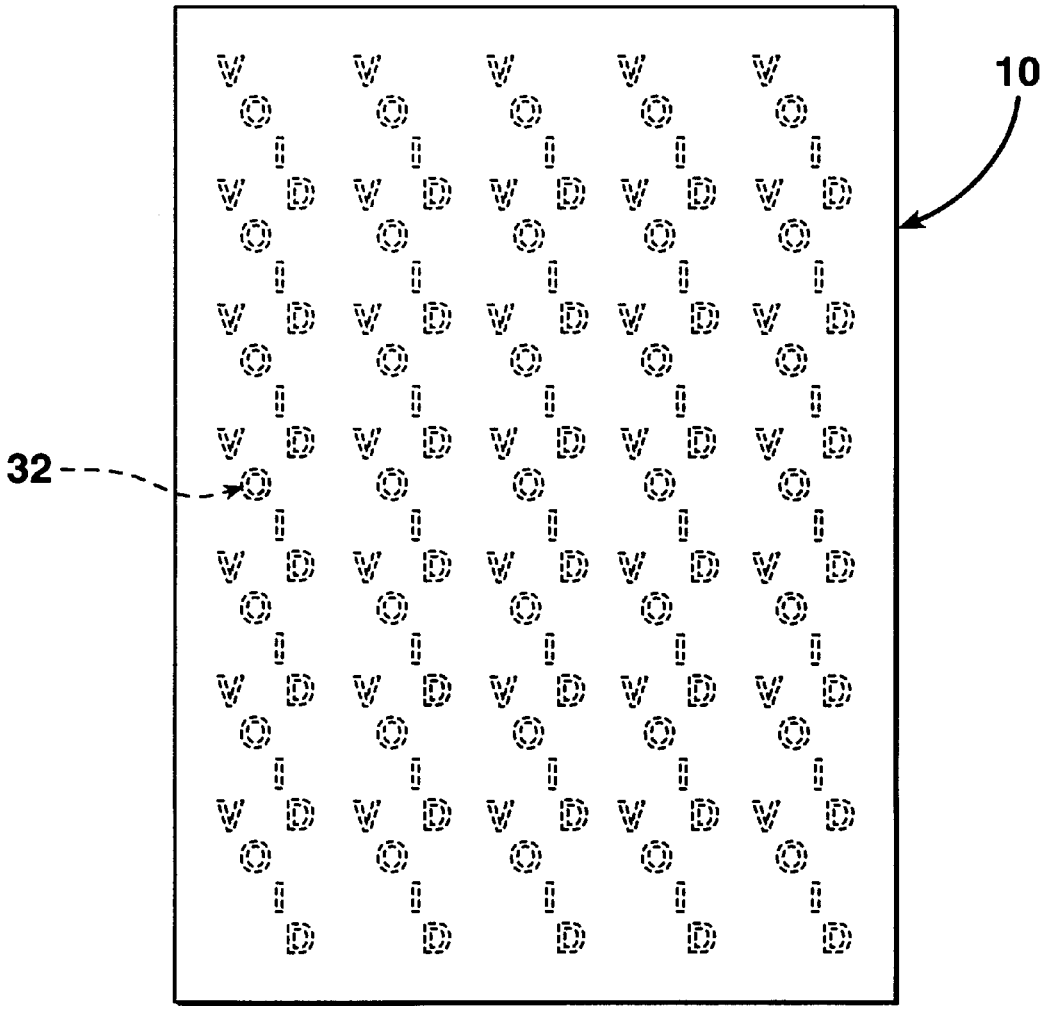
FIG. 2 is a front elevation view of a security document containing the color-forming composition initially printed as covert warning indicia.

FIG. 2 illustrates an embodiment of the invention in which the color-forming composition has been initially printed as covert warning words 32 on the entire surface of the document, in this instance the warning phrase VOID. The words formed by the coating 32 are virtually invisible because of the initially colorless state of the dye, but become visible when exposed to a solvent, or if subjected to abrasion or heat sufficient to cause the reactants to react.

Figure 3:
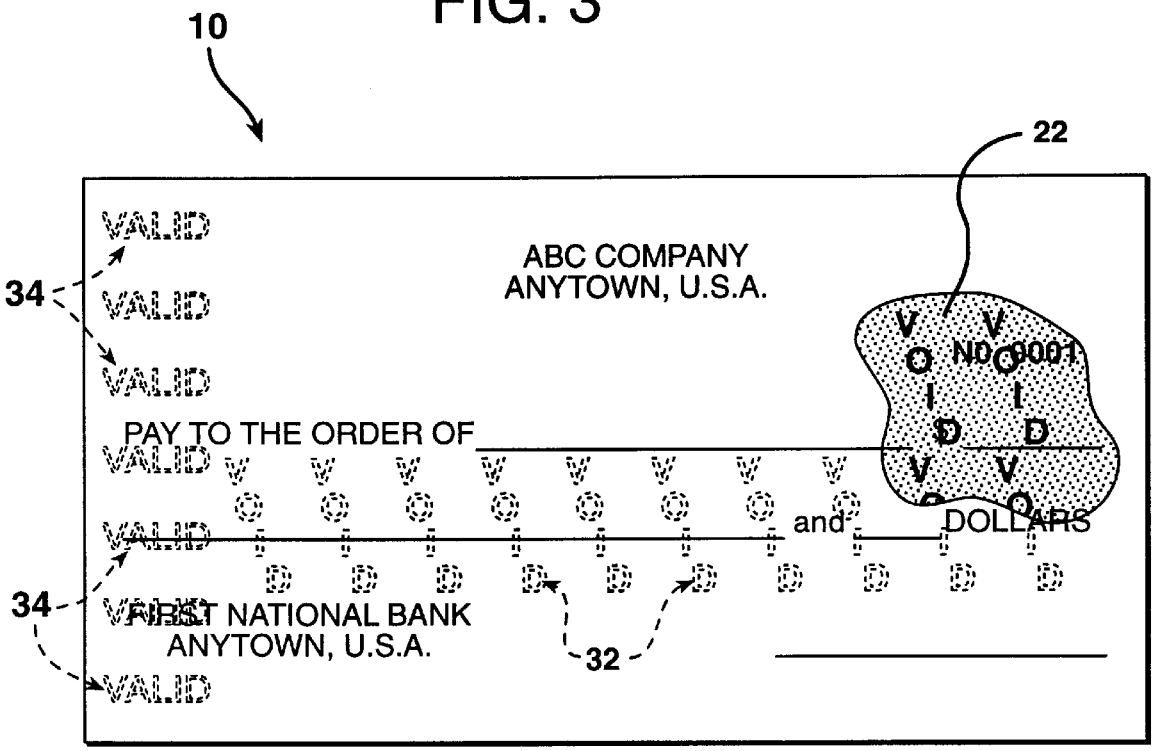
FIG. 3 is a front elevation view of a security document including both authentication and warning indicia and illustrating the appearance of the warning indicia after alteration has been attempted.

FIG. 3 illustrates an embodiment of the invention in which the color-forming composition has been coated on only certain portions of the document. As shown, the monetary amount portions of the document have been printed with the composition in the form of warning indicia 32 while the left hand portion of the document has been printed with authentication indicia 34. If alteration of the coated portion of the document is attempted such as with the use of a solvent as shown in area 22, the warning words become visible. The use of a solvent will either dissolve the leuco dye and/or the color developer which activates the leuco dye and develops a visible color. Likewise, if the document is exposed to heat or abrasion in the areas containing the authentication or warning indicia, the color-forming composition will activate.

In order that the invention may be more readily understood, reference is made to the following examples, which are intended to be illustrative of the invention, but are not intended to be limiting in scope.

EXAMPLE 1

A color-forming composition was prepared by combining the following materials:

| | Weight % |
|---|---|
| 20% polyvinyl alcohol solution | 7 |
| starch solution | 20 |
| Chlorostain OR[1] | 9 |
| 50% Sulfonyl diphenol[2] | 25 |
| Water | 14 |
| 50% black 305 dye[3] | 10 |
| Rhopaque HP 1055[4] | 15 |

[1]amino benzyl thiazol from Bayer
[2]color developer from Alfa Chemical
[3]color former from Nagase America
[4]polystyrene spheres from Rohm and Haas The coating was spot coated by a flexographic printer with a 5.6 BCM anilox roll to provide a dry coat weight of 0.5 lbs./1300 $ft^2$ (1.9 $g/m^2$). The resulting document exhibited solvent and hypochlorite sensitivity to ethyl acetate, ethyl alcohol, acetone, isopropyl alcohol and bleach. The document successfully passed through an Epson laser printer (Action Laser 1500) and a high speed Xerox 4050 laser printer with no premature color development.

EXAMPLE 2

A toner adhesion-enhancing coating was prepared by combining the following materials:

| | Weight % |
|---|---|
| LASERLOCK ™ [1] | 50 |
| Water | 15 |
| Rhopaque HP 1055[2] | 30 |
| Isopropyl Alcohol | 5 |

[1]toner adhesion-enhancing coating from Standard Register (U.S. Pat. No. 5,045,426)
[2]polystyrene spheres from Rohm & Haas The color-forming composition prepared in Example 1 was spot coated onto a substrate by a flexographic printer with a 5.6 BCM anilox roll to provide a dry coat weight of 0.5 lbs./1300 $ft.^2$ (1.9 $g/m^2$). The toner adhesion-enhancing coating prepared above was then applied to the substrate as a full coat using a flexographic printer with a 200 line, 5.6 BCM anilox roll. The resulting document exhibited solvent and hypochlorite sensitivity to ethyl acetate, ethyl alcohol, acetone, isopropyl alcohol and bleach. The document successfully passed through an Epson laser printer (Action Laser 1500) and a Xerox high speed 4050 laser printer with no premature color development.

While certain representative embodiments and details have been shown for purposes of illustrating the invention, it+ will be apparent to those skilled in the art that various changes in the methods and apparatus disclosed herein may be made without departing from the scope of the invention, which is defined in the appended claims.

What is claimed is:

1. A security document which is resistant to premature coloration by heat comprising a substrate having first and second major surfaces, at least one of said major surfaces having thereon a composition comprising an initially colorless color former and a color developer which composition activates to produce a color upon the application of a solvent, heat sufficient to cause said composition to melt, or abrasion, said composition including an insulating material which prevents premature melting of said composition when said document is passed through a noncontact printing device.

2. The security document of claim 1 in which said composition is applied to provide a dry coating weight of between about 0.4 and 0.5 lbs/1300 $ft.^2$ (1.52 to 1.9 $g/m^2$).

3. The security document of claim 1 in which said color former comprises a leuco dye having a melting point of greater than about 150° C.

4. The security document of claim 2 in which said color developer comprises a phenolic resin having a melting point of greater than 150° C.

5. The security document of claim 1 in which said composition is printed on said substrate in the form of covert warning indicia.

6. The security document of claim 1 in which said composition is printed on said substrate in the form of covert authentication indicia.

7. The security document of claim 1 in which said insulating material comprises hollow or solid polymeric spheres.

8. The security document of claim 7 in which said polymeric spheres are comprised of polystyrene.

9. The security document of claim 1 further including a toner adhesion-enhancing composition overlying said composition, said toner adhesion enhancing composition comprising a polymeric toner adhesion-enhancing coating and an insulating material.

10. The security document of claim 9 in which said toner adhesion enhancing composition comprises a latex.

11. The security document of claim 9 in which said toner adhesion-enhancing composition is applied to provide a dry coating weight of between about 0.25 and 0.35 lbs./1300 $ft.^2$ (0.95 to 1.33 $g/m^2$).

12. The security document of claim 9 in which said insulating material in said toner adhesion enhancing composition comprises hollow or solid polymeric spheres.

13. The security document of claim 12 in which said hollow polymeric spheres comprise polystyrene.

14. The security document of claim 9 in which said polymeric toner adhesion-enhancing composition comprises a copolymer of styrene and acrylic acid.

15. A security document which is resistant to premature coloration by heat comprising a substrate having first and second major surfaces, at least one of said major surfaces having thereon a color-forming composition comprising an initially colorless color former and a color developer which color-forming composition activates to produce a color upon the application of a solvent, heat sufficient to cause said color-forming composition to melt, or abrasion, and a toner adhesion-enhancing composition overlying said color-forming composition, wherein both said color-forming composition and said toner adhesion-enhancing composition include an insulating material which prevents premature melting of said color-forming composition when said document is passed through a noncontact printing device.

16. The security document of claim 15 in which said composition includes a binder.

17. The security document of claim 15 in which said insulating material comprises from about 20 to 40% by weight of said color-forming composition.

18. The security document of claim 15 in which said insulating material comprises from about 20 to 40% by weight of said toner adhesion-enhancing composition.

19. The security document of claim 15 in which said toner adhesion-enhancing composition comprises from about 5 to 12% by weight latex.

20. A security document which is resistant to premature coloration by heat comprising a substrate having first and second major surfaces, at least a portion of one of said major surfaces having thereon a composition comprising an initially colorless color former and a color developer which composition activates to produce a color when said substrate is subjected to authentication or attempted tampering or alteration by the application of a solvent, heat sufficient to cause said composition to melt, or by abrasion, said composition including an insulating material which prevents premature melting of said composition when said document is passed through a noncontact printing device.

21. The security document of claim 20 in which said composition is printed on said substrate in the form of covert warning indicia.

22. The security document of claim 20 in which said composition is printed on said substrate in the form of covert authentication indicia.

23. The security document of claim 20 in which said composition is printed on said substrate in the form of covert warning indicia and authentication indicia.

24. A method of printing a heat resistant security document comprising the steps of:

providing a substrate having first and second major surfaces;

coating at least one major surface of said substrate with a composition which may be activated to produce a color, said composition comprising an initially colorless color former and a color developer and including an insulating material which prevents heat transfer from a laser printer to said composition preventing premature melting of said composition;

printing said substrate using a laser printer; and exposing said substrate to a solvent, heat at a temperature of about 400° F. for at least about 1 second, or abrasion such that said composition is activated to form a color.

* * * * *